US005257786A

United States Patent [19]

Gorman

[11] Patent Number: 5,257,786

[45] Date of Patent: Nov. 2, 1993

[54] WOOD-TYPE GOLF CLUB HEAD

[75] Inventor: Geoffrey W. Gorman, Greer, S.C.

[73] Assignee: Dunlop Slazenger Corporation, Greenville, S.C.

[21] Appl. No.: 29,769

[22] Filed: Mar. 11, 1993

Related U.S. Application Data

[63] Continuation of Ser. No. 896,150, Jun. 9, 1992.

[51] Int. Cl.[5] ..... A63B 53/04

[52] U.S. Cl. ..... 273/167 A; 273/174

[58] Field of Search ..... 273/167-77 A, 273/77 R, 193 R, 194 R, 164.1

[56] References Cited

U.S. PATENT DOCUMENTS

| | | | |
|---|---|---|---|
| 1,913,821 | 6/1933 | Stumpf | 273/174 X |
| 2,041,676 | 5/1936 | Gallagher | 273/167 A X |
| 2,756,055 | 7/1956 | Bittner | 273/174 X |
| 2,954,231 | 9/1960 | MacIntyre | 273/169 X |
| 3,068,011 | 12/1962 | Sano | 273/172 X |
| 3,955,819 | 5/1976 | Yokich | 273/167 A X |
| 3,997,170 | 12/1976 | Goldberg | 273/167 A X |
| 4,065,133 | 12/1977 | Gordos | 273/167 E |
| 4,838,555 | 6/1989 | Kobayashi | 273/167 A |

FOREIGN PATENT DOCUMENTS

| | | | |
|---|---|---|---|
| 6733 | 1/1980 | European Pat. Off. | 273/167 A |
| 244925 | 12/1925 | United Kingdom | 273/167 A |

OTHER PUBLICATIONS

Tommy Armour Golf Advertisement, 1991.

*Primary Examiner*—Jessica J. Harrison
*Assistant Examiner*—Sebastiano Passaniti
*Attorney, Agent, or Firm*—Lorusso & Loud

[57] ABSTRACT

A wood-type golf club head comprising toe, heel, top, and sole portions, a front face bounded by the toe, heel, top and sole portions, and a rear wall bounded by the toe, heel, top and sole portions, a peripheral wall depending from the periphery of the sole portion to define a sole cavity in the sole portion, and two struts extending from a portion of the peripheral wall adjacent the front face to a portion of the peripheral wall adjacent the rear wall, the struts being substantially parallel to each other and defining therebetween and in cooperation with the portion of the peripheral wall adjacent the front face, a central portion of the sole cavity, the peripheral wall being interrupted adjacent the rear wall, such that the central portion of the sole cavity is open to the rear of the club head.

3 Claims, 8 Drawing Sheets

WOOD-TYPE GOLF CLUB HEAD

CROSS-REFERENCE TO RELATED APPLICATION

This is a continuation of application Ser. No. 07/896,150, filed Jun. 9, 1992, now pending in the name of Geoffrey W. Gorman.

BACKGROUND OF THE INVENTION

1. Field of the Invention

This invention relates to golf clubs and is directed more particularly to a wood-type golf club head.

2. Description of the Prior Art

It is known to be beneficial to provide on the sole portion of drivers strut members which extend from the bottom of the club and are elongated and disposed generally normal to the impact face of the club. The strut members reduce the drag experienced by the club head as it moves on or adjacent to the playing surface in approaching the ball. Typically, such struts are attached to the club by way of forming part of a plate which is attached, as by screws, to the sole of the club.

U.S. Pat. No. 3,068,011, issued Dec. 11, 1962, to Naojiro Sano, illustrates such prior art practices. In Sano, a plate having two or three fingers extending from a common bar portion is screwed onto the bottom of a club head such that the bar portion is disposed adjacent the impact face of the club head and the fingers extend rearwardly therefrom, forming front-to-rear struts.

The addition of metal plates, and the like, to the sole portion of drivers tends to exacerbate the already prevalent problem of the center of gravity for such clubs being disposed low in the club, removed from the geometric center of the club.

It is beneficial to the golfer to have available a driver, or fairway wood-type club, provided with struts on the sole of the club as an integral part of the club, the club being designed in such manner as to permit location of the center of gravity nearer the geometric center of the club.

SUMMARY OF THE INVENTION

Accordingly, an object of the present invention is to provide a wood-type club head having elongated front-to-rear struts protruding from the sole portion thereof and formed as an integral part of the club.

A further object of the invention is to provide such a club configured so as to place the center of gravity proximate the geometric center of the club head.

With the above and other objects in view, as will hereinafter appear, a feature of the present invention is the provision of a wood-type golf club head comprising a toe portion, a heel portion, a top portion, a sole portion, a front face bounded by the toe, heel, top and sole portions, and a rear wall bounded by the toe, heel, top and sole portions, a peripheral wall depending from the periphery of the sole portion to define a sole cavity in the sole portion, and two struts extending from a portion of the peripheral wall adjacent the front face to a portion of the peripheral wall adjacent the rear wall, the struts being substantially parallel to each other and defining therebetween and in cooperation with the portion of the peripheral wall adjacent the front face, a central portion of the sole cavity, the peripheral wall being interrupted adjacent the rear wall, such that the central portion of the sole cavity is open to the rear of the club head.

The above and other features of the invention, including various novel details of construction and combinations of parts, will now be more particularly described with reference to the accompanying drawings and pointed out in the claims. It will be understood that the particular devices embodying the invention are shown by way of illustration only and not as limitations of the invention. The principles and features of this invention may be employed in various and numerous embodiments without departing from the scope of the invention.

BRIEF DESCRIPTION OF THE DRAWINGS

Reference is made to the accompanying drawings in which are shown illustrative embodiments of the invention, from which its novel features and advantages will be apparent.

In the drawings.

DESCRIPTION OF THE PREFERRED EMBODIMENTS

Figure 1:
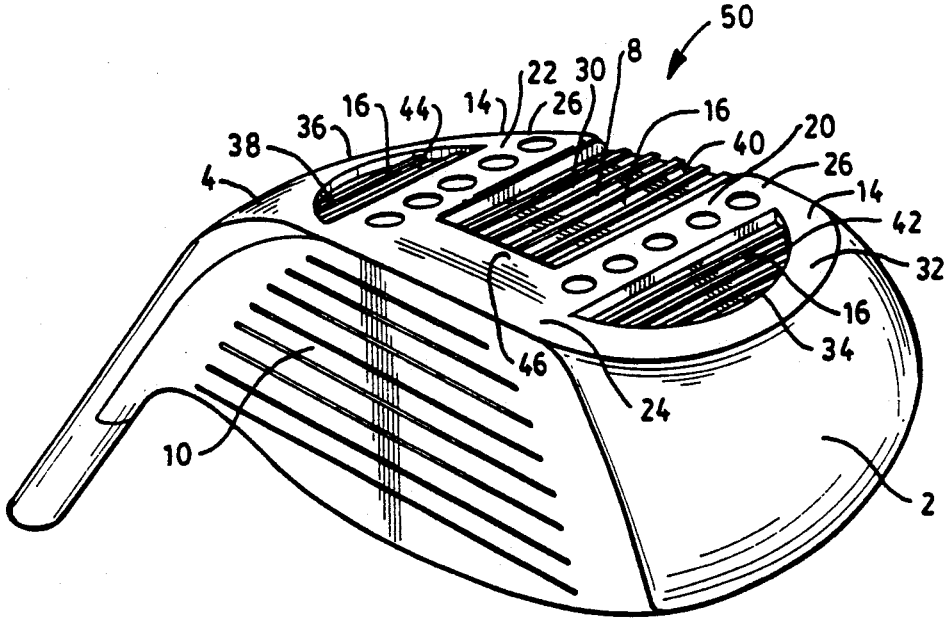
FIG. 1 is a perspective view of one form of golf club head illustrative of an embodiment of the invention.
Figure 2:
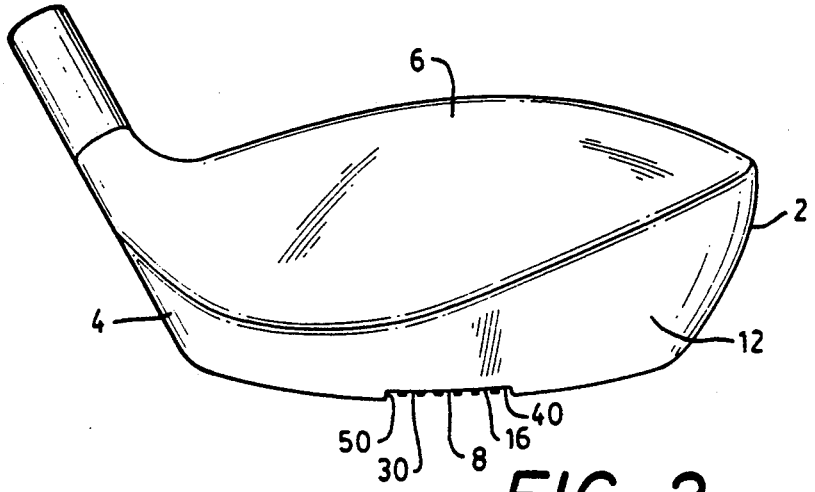
FIG. 2 is a rear elevational view thereof.
Figure 3:
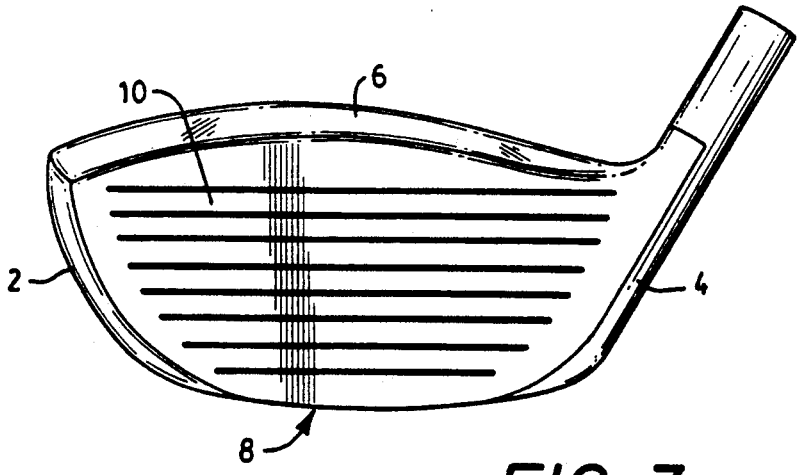
FIG. 3 is a front elevational view thereof.
Figure 4:
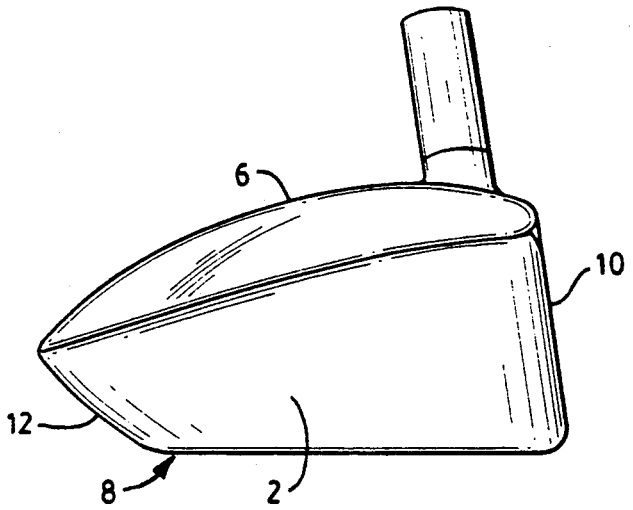
FIG. 4 is a toe end elevational view thereof.
Figure 5:
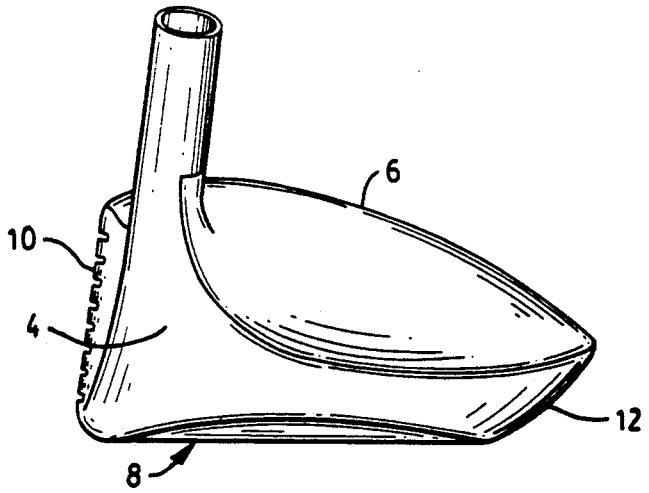
FIG. 5 is a heel end elevational view thereof.
Figure 6:
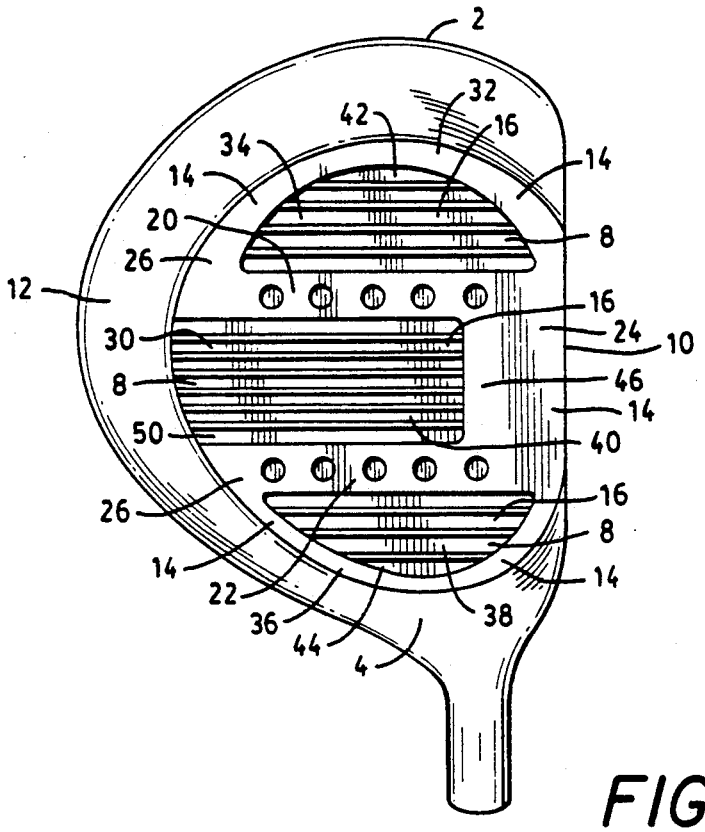
FIG. 6 is a bottom plan view thereof.
Figure 7:
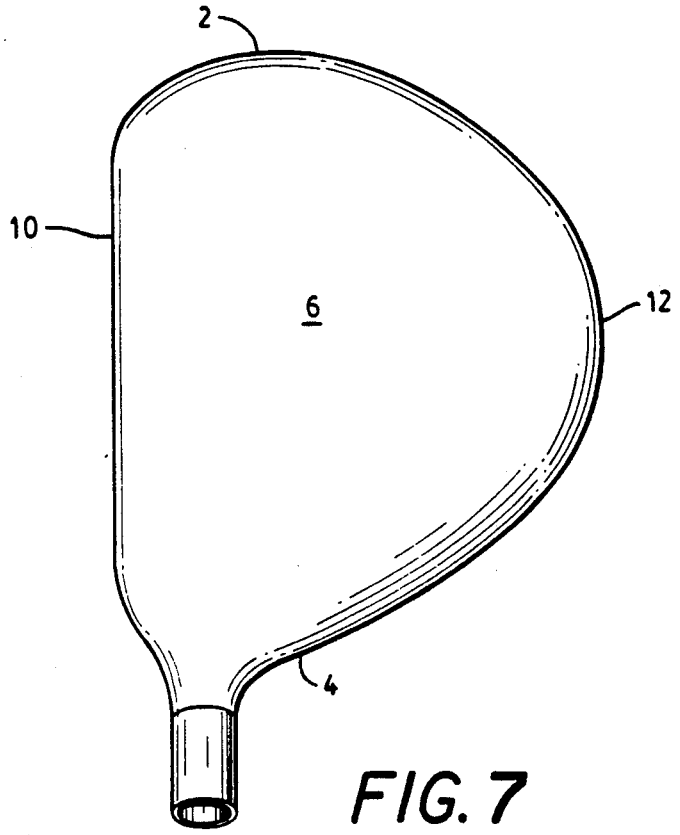
FIG. 7 is a top plan view thereof.
Figure 8:
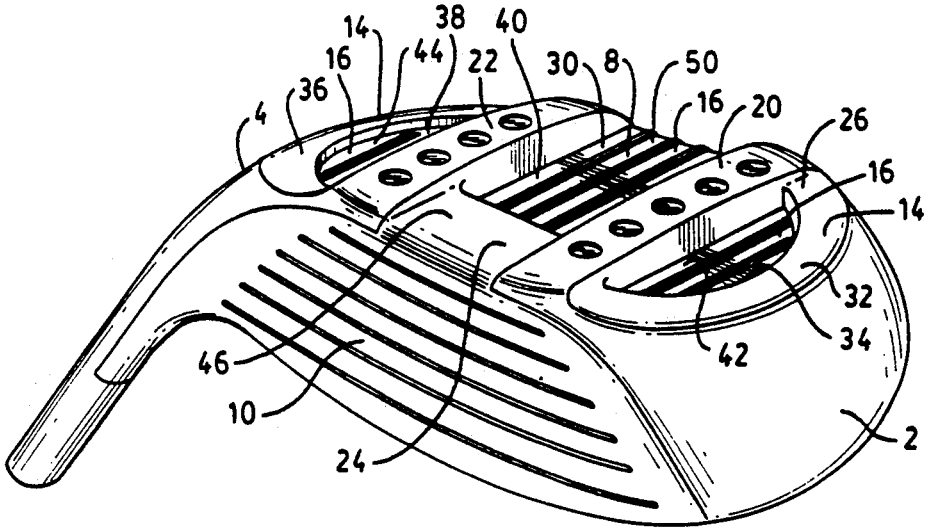
FIG. 8 is a perspective view of another form of golf club head illustrative of an alternative embodiment of the invention.
Figure 9:
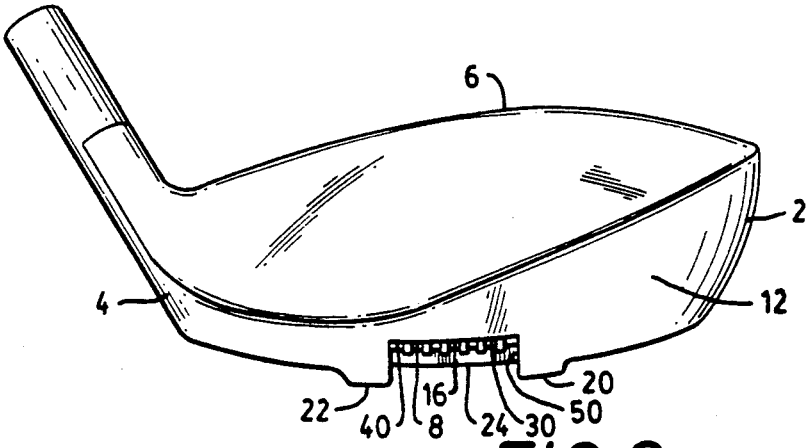
FIG. 9 is a rear elevational view of the club head shown in FIG. 8.
Figure 10:
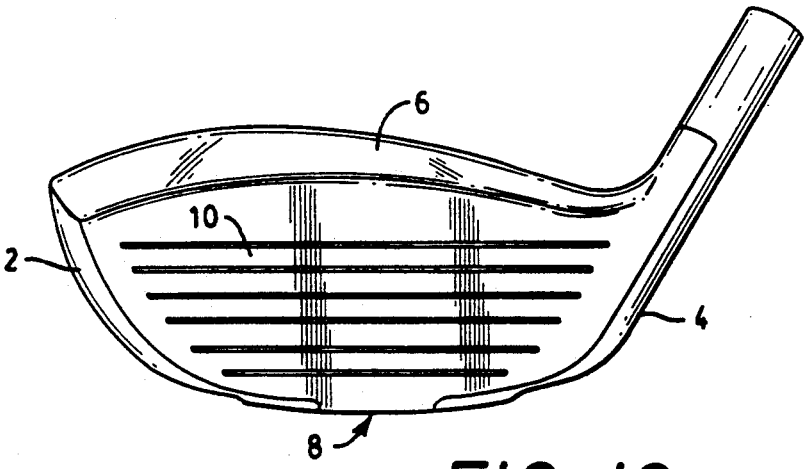
FIG. 10 is a front elevational view thereof.
Figure 11:
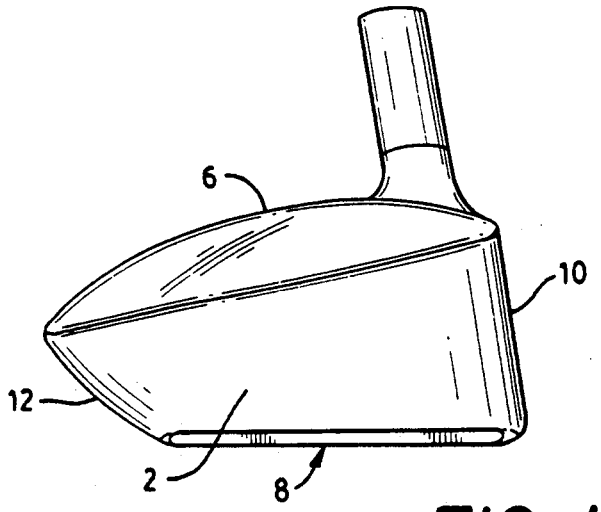
FIG. 11 is a toe end elevational view thereof.
Figure 12:
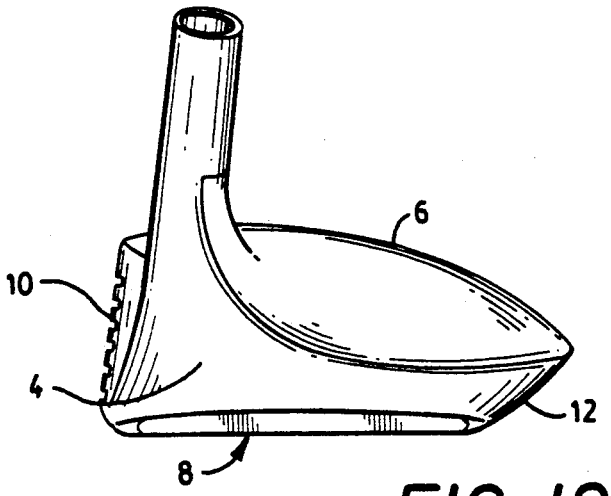
FIG. 12 is a heel end elevational view thereof.
Figure 13:
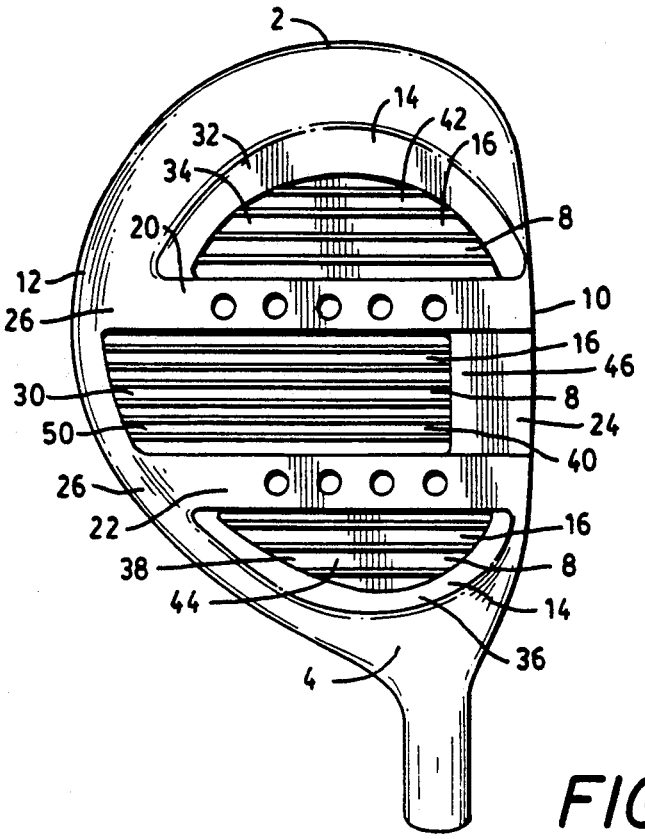
FIG. 13 is a bottom plan view thereof.
Figure 14:
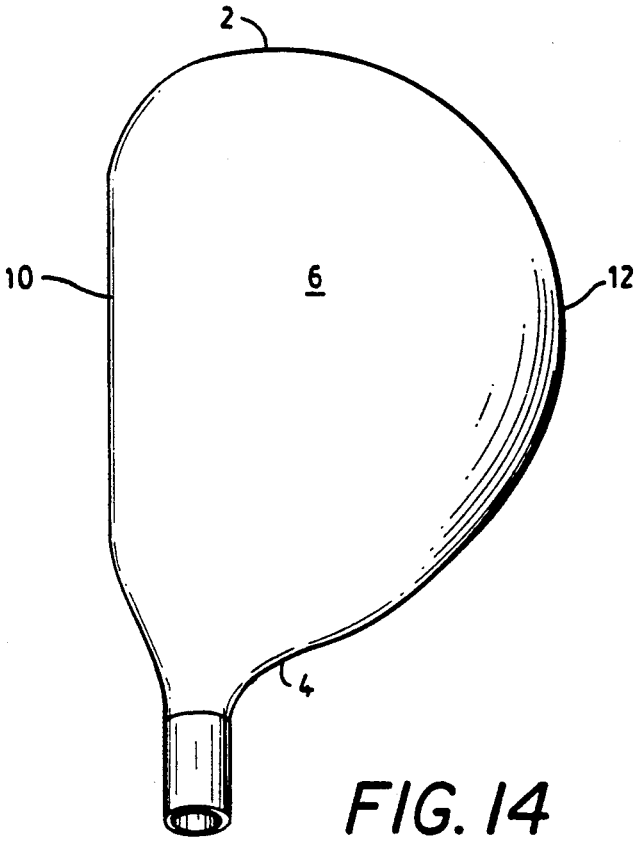
FIG. 14 is a top view thereof.

Referring to the drawings, it will be seen that the illustrative golf club head includes a toe portion 2, a heel portion 4, a top portion 6, and a sole portion 8. The club further includes a front face 10, bounded by the toe portion 2, heel portion 4, top portion 6 and sole portion 8 (FIGS. 3 and 10), and a rear wall 12 bounded by the toe, heel, top and sole portions (FIGS. 2 and 9).

A peripheral wall 14 (FIGS. 1, 6, 8 and 13) depends from the periphery of the sole portion 8 to define a sole cavity 16 in the sole portion. Two struts 20, 22 extend from a portion 24 of the peripheral wall 14 adjacent the front face 10 to a portion 26 of the peripheral wall 14 adjacent the rear wall 12.

The struts 20, 22 are substantially parallel to each other and define therebetween, in cooperation with the portion 24 of the peripheral wall 14 adjacent the front face 10, a central portion 30 of the sole cavity 16. The peripheral wall 14 is interrupted adjacent the rear wall 12, such that the central portion 30 of the sole cavity is open to the rear of the club head.

A first 20 of the two struts and a portion 32 of the peripheral wall 14 adjacent the toe portion 2 define a toe portion 34 of the sole cavity 16. A second 22 of the two struts and a portion 36 of the peripheral wall 14 adjacent the heel portion 4 define a heel portion 38 of the sole cavity 16.

A bottom surface 40 of the central portion 30 of the sole cavity 16 may be disposed more deeply in the club head than bottom surfaces 42, 44 of the toe and heel portions 34, 38 of the sole cavity 16, as in the embodiment shown in FIGS. 8–14. The presence of the sole cavity 16 facilitates disposition of the center of gravity of the club nearer the top portion.

Referring again to FIGS. 1, 6, 8 and 13, it will be seen that the toe portion 34 of the sole cavity 16 is entirely bounded by the first strut 20 and the peripheral wall portion 32 adjacent the toe portion 2, and the heel portion 38 of the sole cavity 16 is entirely bounded by the second strut 22 and the peripheral wall portion 36 adjacent the heel portion 4.

In the embodiment shown in FIGS. 8–14, the struts 20, 22 extend outwardly from the club sole portion 8 further than the peripheral wall 14. That is, the struts are "taller" than the peripheral wall.

In both embodiments illustrated, a segment 46 of the peripheral wall portion 24 adjacent the front face 10, and between the struts 20, 22, is larger than the remainder of the peripheral wall 14, in that the wall segment 46 extends further rearwardly of the club head than does the remainder of the peripheral wall portion 24, and, in the embodiment shown in FIGS. 8–14, extends outwardly from the sole portion of the club farther than the remainder of the peripheral wall 14, though less than the two struts 20, 22.

In both embodiments shown, the bottom surface 40 of the central portion 30 of the sole cavity 16 intersects the rear wall 12 of the club, to define an opening 50 in the rear wall 12.

There is thereby provided a wood-type club head having protective struts formed on the sole portion thereof as an integral part of the club and formed so as to permit a higher location of center of gravity, rather than further lowering the center of gravity.

It is to be understood that the present invention is by no means limited to the particular constructions herein disclosed and/or shown in the drawings, but also comprises any modifications or equivalents within the scope of the claims.

Having thus described my invention, what I claim as new and desire to secure by Letter Patent of the United States is:

1. A one-piece wood-type golf club head comprising a toe portion, a heel portion, a top portion, a sole portion, a front face generally bounded by said toe, heel, top and sole portions, and a rear wall generally bounded by said toe, heel, top and sole portions, said sole portion being integrally formed with said club head and having depending portions defining a sole cavity in said sole portion, said depending portions including a segment adjacent said front face and two struts extending from said segment adjacent said front face toward said sole portion adjacent said rear wall, said struts being substantially parallel to each other and defining therebetween and in cooperation with said segment adjacent said front face the whole of said sole cavity, a planar bottom surface of said sole cavity intersecting said rear wall and in conjunction with said two struts defining an opening rearwardly of said club head, said opening at said rear wall having substantially planar bottom and side walls, said opening thereby being substantially rectangular in configuration.

2. A one-piece wood-type golf club head comprising a sole portion integrally formed with said club head and having portions depending from said sole portion of said club head, said depending portions including a front segment adjacent a front face of said club and forming an integral portion of said front face, and first and second struts extending rearwardly from said front segment, and substantially normal thereto, said first strut being parallel to said second strut, said front segment and said first and second struts forming an open-ended slot in said sole portion, said slot open end defining an opening in a rear wall of said club head, said opening being bound by a substantially planar bottom surface of said slot, a substantially planar side wall of a free end of said first strut portion adjacent said rear wall, and a substantially planar side wall of a free end of said second strut portion adjacent said rear wall.

3. The golf club head in accordance with claim 2, wherein said second strut is disposed inwardly of a heel portion of said club head, and said first strut is spaced from said second strut and nearer a toe portion of said club head, said strut free ends being integral with and coextensive with said rear wall, and bottom surfaces of said struts being exposed, said club being devoid of any sole attachment.

* * * * *